United States Patent [19]

Kurhi

[11] Patent Number: 4,838,189

[45] Date of Patent: Jun. 13, 1989

[54] MAST ATTACHMENT FOR QUICK CONNECT AND DISCONNECT

[76] Inventor: Jaakko Kurhi, 5284 Camino Alta Mira, Castro Valley, Calif. 94546

[21] Appl. No.: 106,697

[22] Filed: Oct. 6, 1987

[51] Int. Cl.[4] ..... B63H 9/00

[52] U.S. Cl. ..... 114/39.1; 114/91; 114/93

[58] Field of Search ..... 114/39.2, 89, 90, 91, 114/92, 93, 94, 95, 96

[56] References Cited

U.S. PATENT DOCUMENTS

| | | | |
|---|---|---|---|
| Re. 31,167 | 3/1987 | Schweitzer et al. | 114/39 |
| 4,449,466 | 5/1984 | Marker et al. | 114/91 |
| 4,477,096 | 10/1984 | Wallace et al. | 279/97 |
| 4,526,120 | 7/1985 | Gaide | 114/91 |

FOREIGN PATENT DOCUMENTS

| | | | |
|---|---|---|---|
| 3420485 | 12/1984 | Fed. Rep. of Germany | 114/91 |
| 3409772 | 6/1985 | Fed. Rep. of Germany | 114/91 |
| 150888 | 7/1986 | Japan | 114/91 |

*Primary Examiner*—Sherman D. Basinger
*Assistant Examiner*—Stephen P. Avila
*Attorney, Agent, or Firm*—Townsend and Townsend

[57] ABSTRACT

A readily detachable and fully rotatable coupling between a mast and sailboard is described, comprising a male portion with a circumferential groove, and a female portion with a recess to receive the male portion, and spring-biased tongues extending into the recess for engagement with the circumferential groove. The tongues are manually retractable for purposes of either engagement or disengagement of the mast from the sailboard.

2 Claims, 2 Drawing Sheets

MAST ATTACHMENT FOR QUICK CONNECT AND DISCONNECT

BACKGROUND OF THE INVENTION

This invention relates to sailboards, and in particular to methods of securing masts to sailboards.

In wind-driven vehicles, such as sailboards, iceboats, wind-surfing boards, skateboards and sleds, the mast which supports the sail must be firmly secured to the base board to withstand strong winds and the pulling forces required to position the sail appropriately to achieve maximal speed. Rapidly shifting winds, road obstacles (in the case of land vehicles) and waves (in the case of sailboats and surfboards) are the caused of frequent upsets of the vehicle, presenting a hazard to the rider and considerable difficult in returning the vehicle and mast to their upright position. When the vehicle begins to topple, the mast merely increases the difficulty of the rider in righting the vehicle, and depending on the wind condition and the weight of the mast, frequently makes the vehicle more unstable than it would otherwise have been.

Existing joints connecting the mast to the base board do little to alleviate this problem. Such joints include multi-axis universal joints as well as spring-biased detent cam arrangements. The most effective solution, however, would be a quick-connect/quickdisconnect joint, which would enable the rider to quickly separate the mast from the base board when needed, such as when changing the board or sailing rigging.

SUMMARY OF THE INVENTION

A novel construction for connecting a mast to a sail board in a secure manner yet instantly releasable has now been developed, consisting of a male portion and a female portion, the former fitting inside a recess in the latter. Retractable tongues in the female portion protruding into the recess mate with a groove in the protruding section of the male portion to lock the two parts into engagement with each other. The tongues are spring-mounted, biasing them into the recess where they engage the groove, but are manually retractable for a quick disengagement. In preferred embodiments, the male member contains appropriate connections for securement to the end of the mast, while the female member is appropriately fitted for securement to the sailboard.

DETAILED DESCRIPTION OF THE INVENTION AND PREFERRED EMBODIMENTS

Figure 1:
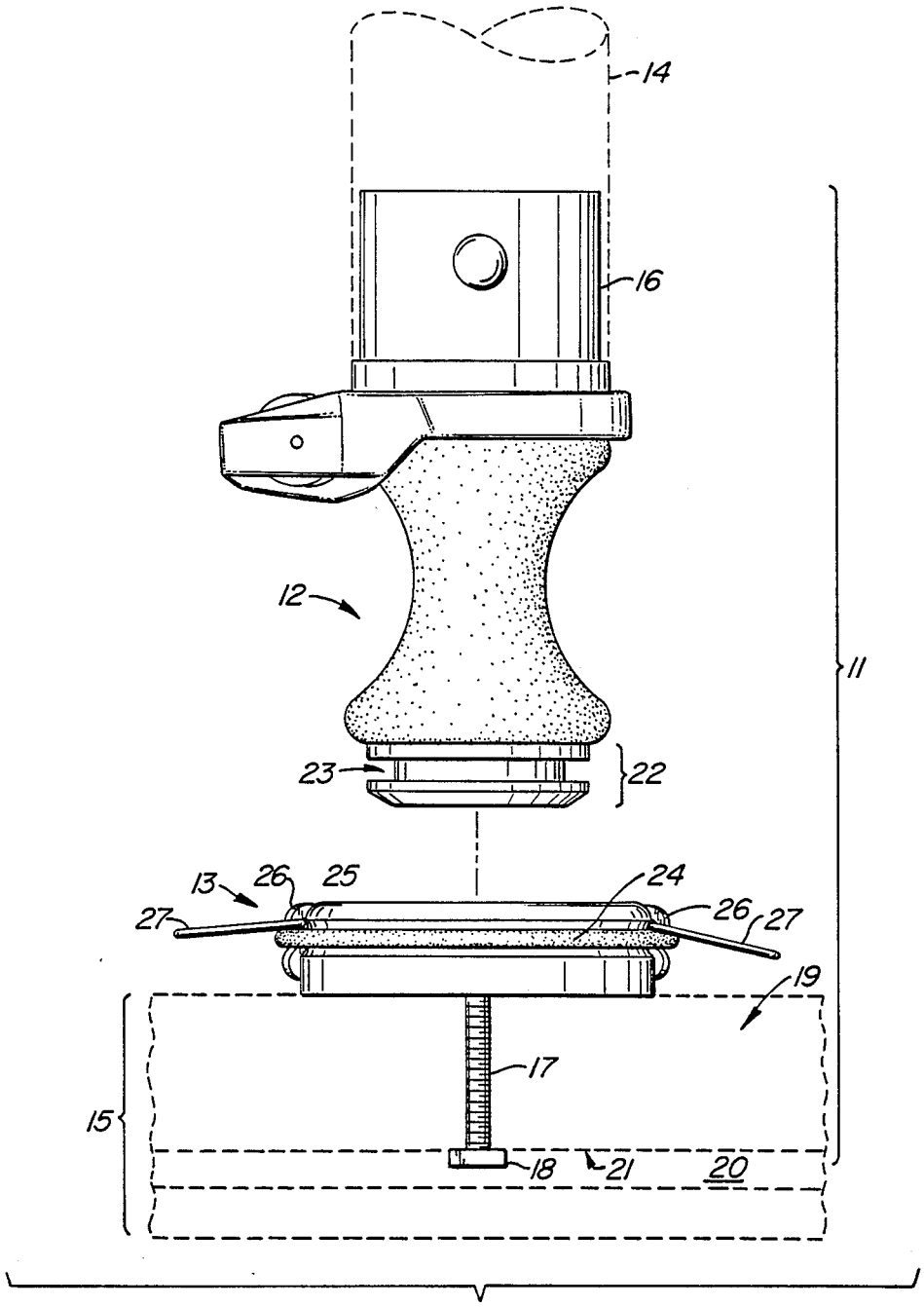
FIG. 1 is a side elevation of one embodiment of a quick-connect and disconnect joint of the present invention, with the male and female portion separated.

The device in FIG. 1 is an illustration of the present invention and how it may connect to a mast and base board. The invention resides in the coupling 11, which consists of two parts, a male portion 12 and a female portion 13. The male portion 12 is secured to the end of a mast 14 (shown in dashed lines), while the female portion 13 is secured to the base board 15 (also shown in dashed lines). In this particular embodiment, the connection between the male portion 12 and the mast 14 is achieved through a sleeve 16 on the upper end of the male portion, into which the mast 14 may be inserted, with conventional methods for holding the two together (not shown). The female portion 13 is secured to the base board 15 by a screw 17 terminating in an expanded nut 18. The screw is inserted through a slot 19 in the base board 15, the slot opening into an expanded channel 20 inside the base board 15. Tightening of the screw forces the nut 18 up against an inverted shoulder 21 at the top of the channel 20, securing the female portion 13 in place. The slot 19 in this embodiment is elongated to permit adjustment of the position of the joint along the length of the base board to meet the particular needs of the rider.

Turning now to the construction of the joint itself, the male portion 12 terminates in a protuberance 22 which fits into a recess (not visible in this figure) in the female portion 13. The protuberance is circular in its preferred form. Extending around the protuberance is a circumferential groove 23, which receives tongues (not shown) protruding into the recess in the female portion, the tongues thereby locking the two parts together. The tongues are slidable in and out, but are biased inward by an elastic ring 24 which encircles the outside of the female portion 13, resting in a groove 25 around the periphery of the latter. The outer edges 26 of the tongues are visible in FIG. 1, and attached to these are finger grips 27 (metallic loops) by which the tongues may be pulled outward, thereby clearing the circumferential groove 23 and releasing the male portion 12 so that it may be lifted out of the recess.

Figure 2:
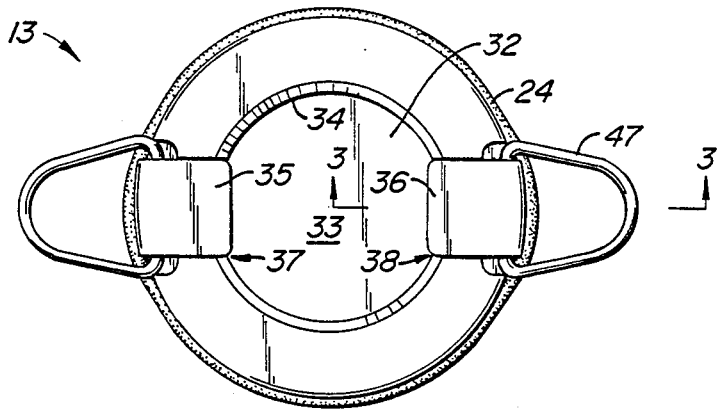
FIG. 2 is a top view of the female portion of the joint shown in FIG. 1.

A more detailed view of the female portion is shown in FIG. 2. Here may be seen that the female portion, like the protuberance in the male portion itself, is of circular configuration, with a circular recess 32 in its upper side. The recess is defined by a flat floor 33 and a generally cylindrically shaped side wall 34. The recess is sized for a loose fit of the protuberance 22 of the male portion (FIG. 1) to permit easy insertion and removal of the latter.

The two tongues 35, 36 are shown in this embodiment, placed directly opposite each other in the recess side wall 34, where they pass through openings 37, 38. When addressed, the tongues protrude into the recess as shown, where they engage the circumferential groove (FIG. 1). It will be noted that the male portion 12 may be inserted in any rotational direction about its axis, and once inserted may still be rotated freely.

While the embodiment shown in these drawings has two tongues, any number of tongues from one on upward will suffice. Two or more are preferred, although two alone will be most preferred.

Figure 3:
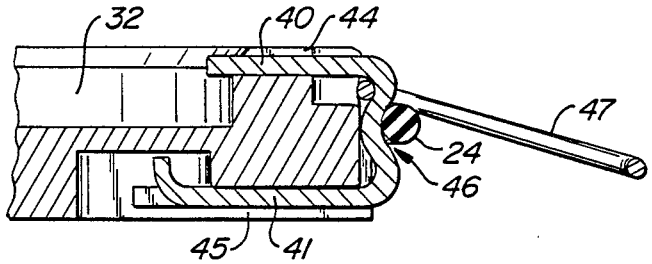
FIG. 3 is a cutaway view of the female portion shown in FIG. 2, taken along the line 3—3 thereof.

The shape of the tongues and their means of attachment to the female portion is most clearly shown in FIG. 3. Each tongue consists of an upper section 40, a lower section 41, and a connecting section 42. The upper section 40 is the operating section, which protrudes into the recess 32. The upper and lower sections rest in upper and lower flat grooves 44, 45 in the body of the female portion, in a loose fit which permits sliding back and forth in the radial direction of the male portion.

The connecting section 42 of the tongue has a grove 46 which receives the elastic ring 24, the elastic ring thereby urging the tongue inward toward the center of the recess. A loop 47 attached to the tongue permits one to pull the tongue outward, placing the elastic ring 24 under tension, and retracting the upper section 40 of the tongue from the recess 32.

The foregoing is offered primarily for purposes of illustration. It will be readily apparent to those skilled in the art that variations and modifications of the various elements of the structure described herein may be made without departing from the spirit and scope of the invention.

What is claimed is:

1. Apparatus for detachably connecting a mast to a sailboard, said apparatus comprising:

a connecting member securable to an end of said mast, said connecting member terminating in a circular end having a circumferential groove;

a receiving member securable to said sailboard, said receiving member containing a recess to receive said circular end of said connecting member;

at least one tongue mounted to said receiving member in a manner permitting sliding thereof to a groove-engaging position in which said tongue protrudes into said recess to engage said circumferential groove of said connecting member; and an elastic band encircling said receiving member and engaging said tongue, said elastic band retained in a first band-retaining groove in said receiving member and second band-retaining groove in said tongue.

2. Apparatus for detachably connecting a mast to a sailboard, said apparatus comprising:

a connecting member securable to an end of said mast, said connecting member terminating in a circular end having a circumferential groove;

a receiving member securable to said sailboard, said receiving member containing a circular recess to receive said circular end of said connecting member, said circular recess defined by a floor and a cylindrical side wall;

first and second tongues slidably mounted to said receiving member at directly opposing locations along said cylindrical side wall in a manner permitting sliding thereof to a groove-engaging position in which each said tongue protrudes into said recess to engage said circumferential groove of said connecting member and thereby retain said circular end of said connecting member in said recess;

an elastic ring encircling said receiving member and engaging said first and second tongues to urge said first and second tongues to said groove-engaging position; and first and second finger grips on said first and second tongues respectively to permit manual retraction thereof from said grooveengaging position and thereby release said circular end of said connecting member from said circular recess.

* * * * *